US005089742A

United States Patent [19]

Kirkpatrick et al.

[11] Patent Number: 5,089,742

[45] Date of Patent: Feb. 18, 1992

[54] ELECTRON BEAM SOURCE FORMED WITH BIOLOGICALLY DERIVED TUBULE MATERIALS

[75] Inventors: Douglas A. Kirkpatrick, Laurel, Md.; Joel M. Schnur, Burke; Paul E. Schoen, Alexandria, both of Va.; Ronald R. Price, Stevensville; Wallace M. Manheimer, Silver Spring, both of Md.

[73] Assignee: The United States of America as represented by the Secretary of the Navy, Washington, D.C.

[21] Appl. No.: 589,757

[22] Filed: Sep. 28, 1990

[51] Int. Cl.[5] ..... H01J 9/02

[52] U.S. Cl. ..... 313/351; 445/51; 445/35

[58] Field of Search ..... 313/351; 445/50, 51, 445/52, 35, 24

[56] References Cited

U.S. PATENT DOCUMENTS

| | | | |
|---|---|---|---|
| 2,189,340 | 2/1940 | Donal | 445/52 |
| 2,197,753 | 4/1940 | Liebmann | 445/35 |
| 3,562,881 | 2/1971 | Barrington et al. | 445/49 |
| 3,746,905 | 7/1973 | Shelton et al. | 313/351 |
| 4,344,104 | 8/1982 | Habets et al. | 313/351 |
| 4,877,501 | 10/1989 | Schmur et al. | 260/405.6 X |

*Primary Examiner*—Kenneth J. Ramsey
*Attorney, Agent, or Firm*—Thomas E. McDonnell; Barry A. Edelberg

[57] ABSTRACT

A field emitter array comprises an array of aligned metallic, conductive microtubules extending from a conductive base. The array is typically made by cutting a matrix comprising the aligned microtubules into sections, usually normal to the tubule alignment axis. One end surface of a section is etched or otherwise treated to remove the matrix, but not the tubules. That end surface is then provided with a conductive coating and fixed to a contact. The other end surface of that section is then also treated to remove the matrix material and leave the tubules extending from the conductive metal base. Field emitter arrays made according to the present invention provide a greater brightness than conventional field emitter arrays.

22 Claims, 3 Drawing Sheets

ELECTRON BEAM SOURCE FORMED WITH BIOLOGICALLY DERIVED TUBULE MATERIALS

BACKGROUND OF THE INVENTION

1. Field of the Invention

The present invention relates in general to electron beam sources and more particularly to a field emitter array-type electron beam source.

2. Description of the Prior Art

The generation of macroscopic electron beam currents through vacuum field emission from a large number of emission sites requires a surface with a complex microstructure. To date, the fabrication of surfaces suitable to this task has been dominated by microlithographic techniques. In these processes, masks are used in conjunction with etching or deposition techniques to produce arrays of micron-scale cones or wedges.

The limitations of present electron source technology are experienced on a regular basis by those involved in microwave devices, high energy particle accelerators, laser pumping, and a host of other fields which utilize electron beams as a means of energy transfer. Presently available electron beam sources divide into three categories: thermionic emitters, laser-activated photoemitters, and field emitters. Included in this last category are both exploding field emitters, sometimes termed plasma cathodes, and vacuum field emitters which do not form an intermediate plasma. Recent interest in vacuum field emission has concentrated on microlithographically fabricated field emitter arrays that employ a nearby gate electrode.

Laser-activated photo-emitters use a high-power, short pulse laser to photo-eject electrons from a Cesiated cathode surface. Current densities greater than 400 $A/cm^2$ at the cathode surface have been reported, for short pulses. The short pulse nature of this type of cathode is dictated by the high-power laser necessary to activate the cathode surface. The vacuum requirements of $10^{-10}$ torr or better place this cathode in the ultra-high vacuum range, making it infeasible for widespread use.

Thermionic cathodes presently available commercially have a cathode current density of no more than 20 $A/cm^2$, with a required vacuum pressure of between $10^{-7}$ and $10^{-8}$ Torr during operation. There are research thermionic cathodes, based on scandate surfaces, which might generate current densities on the order of 100 $A/cm^2$. These cathodes suffer from short lifetime and non-uniform emission. Equally as important is the list of materials not available for intra-vacuum use because they will poison the sensitive, Barium-Oxide or Lanthanum-hexa-Boride emission surface: nickel, gold, Steatite (non-$Al_2O_3$ ceramics), iron (steels), platinum, titanium, carbon, tantalum, hydrocarbons, carbon dioxide, sulfur hexafluoride, and others.

Field emission cathodes, and particularly the explosive type, are the simplest class of cathodes to use, but, in another sense, are the most limited. Field emission cathodes operate by applying a large electric field to an emission surface, perhaps reactor grade graphite (carbon). The large field draws electrons out of the material by quantum tunneling. Presently, this process describes only the initial phase of "turn on". The initial current generated in this phase is emitted from small microscopic protrusions in the surface of the material; the large currents drawn though these small tips results in large local Ohmic heating of the tips, which subsequently ablate and produce a cathode surface plasma. Subsequent emission of electrons occurs from this cathode plasma, which has a very low work function and allows for high current densities to be generated ($I > 100{,}000$ $A/cm^2$). The significant drawback of this process is that the generated cathode plasma typically expands towards the anode at a rate of 1 to 2 cm/μsec, which limits the useful pulse length and precludes repetitively pulsed operation (the expanding plasma reduces the effective cathode-to-anode distance because emission occurs from the leading edge of the plasma. The decreased cathode-anode spacing increases the current which is drawn, since this type of situation is described by Child-Langmuir space-charge limited flow, resulting in electron gun impedance collapse). Field emission cathodes which operate without producing a plasma have to date been limited to single-tip or few tip emission arrays, which are not useful for the generation of macroscopic electron beams.

SUMMARY OF THE INVENTION

Accordingly, it is an object of the present invention to produce an electron beam source which achieves high macroscopic current densities.

It is another object of the present invention to produce an electron beam source which achieves high macroscopic current densities without severe vacuum requirements.

It is a further object of the present invention to produce an electron beam source which achieves high macroscopic current densities in continuous or repetitively pulsed operation environments.

It yet another object of the present invention to produce an electron beam source which achieves high macroscopic current densities and allows for intra-vacuum utilization of higher vapor pressure materials which would poison and degrade thermionic electron beam transmitters.

These and other objects are achieved by a cathode having an emitter comprising a plurality of electrically conductive (generally metal) hollow cylinders, having typical radii of less than about 0.5 microns, and usually less than about 0.3 microns. The invention is exemplified by a cathode, particularly a field emitting cathode, comprising a plurality of aligned, self-assembled, metal microstructures, called tubules, disposed in and extending from a conductive base. The tubules have outer diameters that can be controlled between about 0.1 to 1.0 microns. The wall thickness before metallization is typically about 300 to 600 Å. Metallization generally adds another 200 to 400 Å to the wall thickness. Processing removes the lipid template leaving only the submicron metal cylinder. Throughout the specification and the claims that follow, the term "metal tubule" refers to the metal-coated lipid structure or the hollow metal cylinders, unless indicated otherwise, either explicitly or by context. The term "tubule" is a general term and, depending on the context within which it is employed, may refer to the lipid structure, the metal-coated lipid structure, or the hollow metal cylinder.

In an exemplary method of production, the metal tubules are mixed with a liquid or viscous matrix material such as an uncured epoxy to form a composite matrix. The tubules are aligned in a magnetic, electric, or flow field while the liquid or viscous I matrix material hardens. The hardened matrix is then cut into sections, usually normal to he tubule alignment axis. One end surface of a section is etched or otherwise treated to remove the matrix, but not the tubules. That end surface is then provided with a conductive coating and fixed to a contact. The other end surface of that section is then also treated to remove the matrix material and leave the tubules extending from the conductive metal base.

BRIEF DESCRIPTION OF THE DRAWINGS

A more complete appreciation of the invention will be readily obtained by reference to the following Description of the Preferred Embodiments and the accompanying drawings in which like numerals in different figures represent the same structures or elements, wherein.

DESCRIPTION OF THE PREFERRED EMBODIMENTS

The field emitter array according to the present invention is made possible by the recent discovery of self-assembling microstructures which have been termed "tubules", based on their striking similarity to paper soda straws but of a micron size scale. These tubules are hollow, have typical dimensions of 0.5 μm diameter and lengths from about 50 μm to over about 200 μm. Equally as important as their dimensions is the capability for the tubules to be electroplated with a variety of metals, including copper, nickel, gold, iron, cobalt, and permalloy. The coating covers both the inside an outside surfaces of the tubules, including the ends. Tubules coated with ferromagnetic metals can be aligned in an external magnetic, electric or flow field, allowing the fabrication of composites of aligned tubules in a host matrix. These tubules, their manufacture and their alignment, are discussed in more detail in copending U.S. patent application Ser. No. 07/575,749, filed Aug. 31, 1990, entitled "Metallized Tubule-Based Artificial Dielectric"; the Schnur et al, U.S. Pat. No. 4,867,917; the Schoen et al U.S. Pat. No. 4,877,501, filed Feb. 29, 1988; and U.S. Pat. No. 4,911,981 also to Schnur et al, all of which applications and patents are incorporated, in their entirety, into the present specification.

Any nonrandom pattern of alignment can be used. In general, the tubules will be uniformly and randomly spaced in a plane transverse to the axis of alignment. Typically, the tubules will be aligned axially, so that the finished emitter comprises the tubules extended perpendicularly from a conductive base. The tubules, however, may be aligned in other patterns, for example radially. Composites having radially aligned metal tubules can be cut along an axial plane of the composite and processed as described above and below to provide an field emitter suitable for a curvelinear display.

Figure 1:
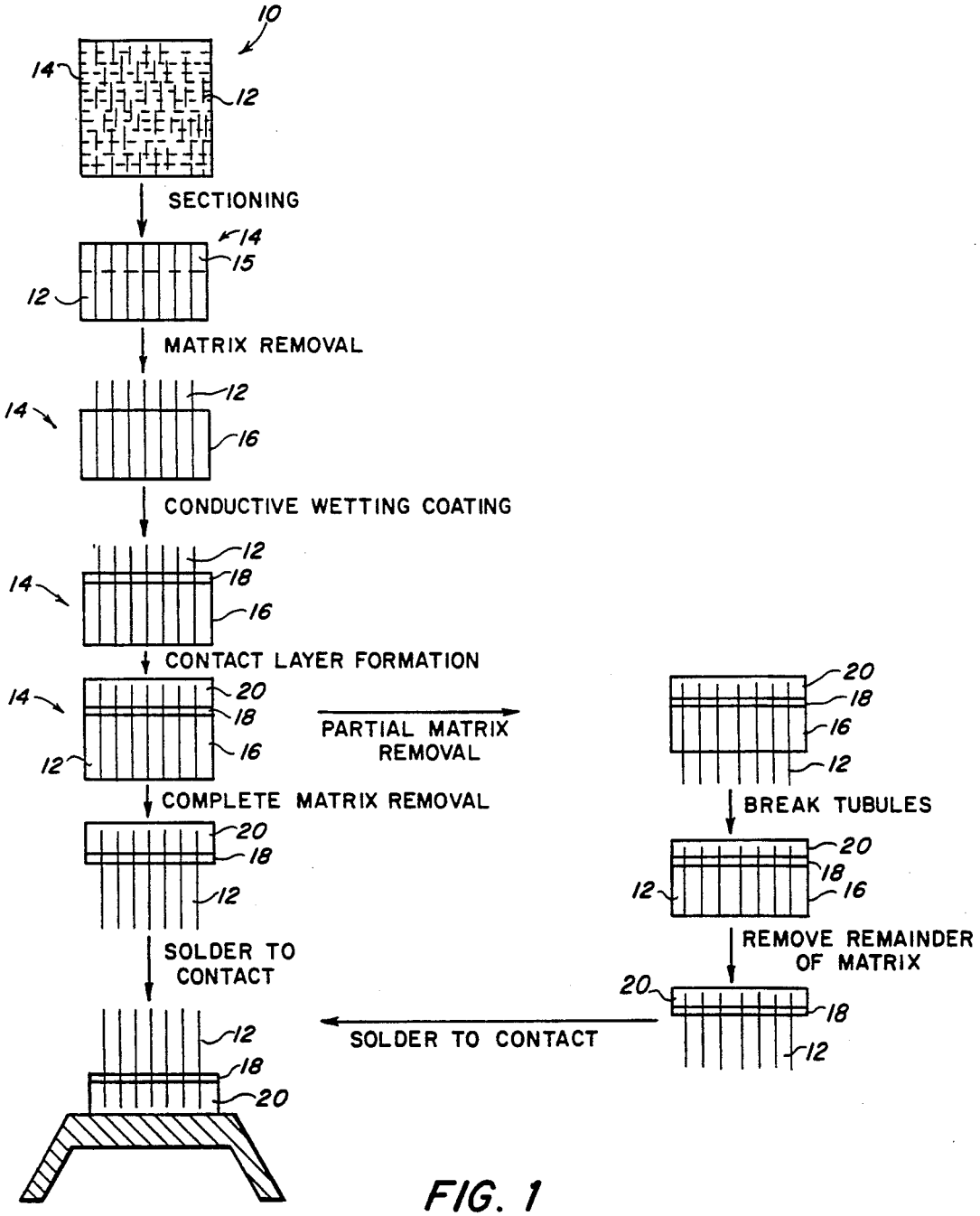
FIG. 1 is a schematic flow diagram showing a general process for production of a field emitter according to the present invention.

The composite containing aligned metal tubules can be formed into a field emitter by a variety of techniques. Generally, as shown in FIG. 1, which is not to scale, the composite 10, having aligned tubules 12, is first cut into sections 14 normal to the axis or plane of tubule alignment. Preferably, these sections are thin, typically 15 to 100 microns and most preferably 25 to 30 microns, to assure that the vast majority of tubules traverse the entire length of the section. Of course, if the sections are too thin, insufficient matrix remains to support the tubules during further processing.

Then, considering one section 14 as an example, a small thickness 15 of matrix material is removed from one end of the section to expose the bare conductive tubules 12. The thickness of matrix removed depends mostly on the amount of conductive metal to be applied in latter steps and, in unusual circumstance where a large excess of conductive metal will be applied, the thickness of the remaining matrix. The remaining matrix thickness 16 should be sufficient to permit further handling of the composite section 14. Typically 5 to 10 μm of matrix are removed.

The matrix may be removed in any manner that provides controlled removal of the matrix without significantly damaging the conductive tubules. For example, the matrix may be plasma etched or, if the matrix is soluble (e.g., PMMA (preferably noncrosslinked or only crosslinked as little as possible), sol gel, photoresist material such as Novalac TM or wax), selectively dissolved.

After thickness 15 has been removed from one end of the matrix material, the end from which the matrix has been removed is coated with a conductive material which covers the end of the exposed tubules, wets and forms a good contact with the tubules, and forms a smooth base to provide good wetting of a macroscopic contact. For economic reasons, the conductive material is generally formed from two layers of different metals. First layer 18 should wet the tubules and provide good electrical contact therewith. The choice of material for layer 18 therefore depends upon the metal on the outer surface of tubules 12. For tubules having an outer surface of nickel metal or nickel oxide, layer 18 is preferably gold, although other environmentally stable electrically conductive metals may be used. Where layer 18 is an expensive metal such as gold, the layer 18 should be as thin as possible but sufficiently thick to provide good electrical contact with the tubules 12. For example, where layer 18 is gold, layer 18 is only about 500 Å thick. When selecting the material used for layer 18, the processing used to remove the matrix thickness 15 should be kept in mind. For example, where thickness 15 is removed by plasma etching, a layer of nickel oxide forms on the outer surface of the tubules, and layer 18 should be an environmentally stable electrically conductive metal capable of wetting nickel oxide.

After layer 18 has been applied, the electrically conductive layer is completed by covering layer 18 with a layer 20 of a cheaper electrically conductive metal, such as silver or copper, with silver being most preferred because it is more easily put down. The metal selected for layer 20 should be capable of wetting and forming a good electrical contact with the metal of layer 18 and capable of forming a smooth base which can wet and form a good electrical contact with a macroscopic contact. Preferably, the metal of layer 18 is also thermally conductive and relatively inexpensive to put down.

If the remaining matrix material 16 is sufficiently thin, it can be removed by plasma etching or dissolution to provide a conductive base 21 having tubules 12 of the desired height exposed and extending therefrom. If the remaining matrix material is too thick, it is partially etched, the exposed portion of tubules 12 is broken off and the remaining matrix material 16 is then removed as described above to provide a conductive base 21 having tubules 12 of the desired height exposed and extending therefrom.

After the conductive base 21 with tubules 12 extending the desired height therefrom has been formed, the end of base 21 opposite the exposed tubules 12 is electrically connected, for example by soldering, to a macroscopic contact, such as a copper stub. The macroscopic contact can be of any material which can form a good electrical contact with the end of the conductive base opposite the exposed tubules.

If possible, as little plasma etching as possible should be performed since plasma etching can injure the electrically conductive tubules. It should also be noted that the phospholipid onto which the electrically conductive metal is coated is merely a template for the formation of the hollow, electrically conductive metallic tubules. Therefore, after the tubules have been metal coated, it is of no consequence if the phospholipid is destroyed during subsequent processing or use.

The process of quantum field emission from a one-dimensional cold-cathode system is described by the Fowler-Nordheim field emission current density $$J = \frac{A(\beta E)^2}{\phi t^2(y)} \exp\left(-B\frac{\phi^{3/2}v(y)}{\beta E}\right) \mathrm{A/cm^2} \tag{1}$$

where $A=1.54\times10^{-6}$, $B=6.87\times10^{7}$, $y=3.79\times10^{-4}(-(\beta E^{\frac{1}{2}}/\phi)$, $t^2\approx1.1$, $v(y)\approx0.95\text{-}y^2$, E is the applied electric field in V/cm, $\beta$ is the field enhancement factor due to local geometry, and $\phi$ is the work function in eV of the surface emission material. Precise values for $t^2(y)$ and $v(y)$ are tabulated in the literature. This type of emission is very sensitive to the local electric field, $\beta E$. For $\beta E=3\times10^7$ V/cm, J is reduced to 1.17 A/cm$^2$. The current density available from this type of emitter is clearly dependent on the local electric field at the emission site. Achieving steady state fields on the order of $10^8$ V/cm is not possible without the use of structures that significantly enhance the electric field.

The necessary local enhancement of the applied electric field is produced by the geometry of the exposed tubule: their height and width, the average spacing between nearest neighbors, the radius of curvature at the edge of the exposed hollow cylinder, and the character of the surface in the vicinity of the exposed edge. The local field enhancement due to the height and width of the exposed hollow cylinder can be approximated as that due to a Lorentzian protrusion. The field structure surrounding a Lorentzian-like surface bump has been calculated to be $$E_x + iE_y = \frac{-iE[x - i(y+b)]}{\{[x - i(y+b)]^2 + a^2\}^{\frac{1}{2}}} \tag{2}$$

where E is the applied field a large distance away from the surface protrusion, x is in the direction along the surface, y is in the direction perpendicular to the surface, and a and b are conformally mapped parameters from the height and width of the bump:

$$b \approx (w/3.464)\left[1 + \frac{w}{3.464h}\right];\ a \approx h + \frac{w}{3.464} \tag{3}$$

An estimate of the Lorentzian profile that closely fits the borders of the exposed emitter in the neighborhood of the tip gives $w\sim4\times R_{cyl}$, where $R_{cyl}$ is the radius of the cylinder. For a single protrusion of height $h=10$ $\mu$m, width $w=2$ $\mu$m, $a\sim10$ $\mu$m, $b\sim0.56$ $\mu$m, and letting $\delta=b/a$ $$E_y \approx E_0 \times \left\{\frac{(b+h)}{[a^2-(b+h)^2]^{\frac{1}{2}}}\right\} = E_0 \times \frac{1}{\sqrt{2}}\ \frac{1}{\delta}\ \sqrt{1+\delta} \approx E_0 \times 10 \tag{4}$$

giving us a field enhancement factor of about 10. The error incurred by neglecting the presence of other tips in the calculation of the previous enhancement factor can be estimated by calculating $E_x$, the transverse field component, at a distance from the one tip corresponding to the midpoint between two tips. By symmetry, a fully accurate, many-tip calculation would give $E_x=0$. Again, using the field structure above, for $x=5$ $\mu$m, $y=10$ $\mu$m $E_x/|E|$ is calculated as 0.1. Therefore the calculation of the previous enhancement factor is estimated to be too large by about 10%.

The effect of the radius of curvature of the exposed tip can be approximated by the calculation of the field enhancement due to two concentric spheres. The inner sphere has a radius corresponding to the radius of curvature of the exposed tip, $R_{in}=R_{tip}$. The outer sphere has a radius of curvature corresponding to half the average distance between two exposed tips, $R_{out}=\Delta x/2$. With a nominal voltage $V_A$ applied between the two spheres, the electric field at the inner sphere is $$E(R_{in}) = \frac{V_A}{R_{out}-R_{in}} \times \frac{R_{out}}{R_{in}}, \tag{5}$$

which corresponds to a field enhancement factor $R_{out}/R_{in}=\frac{1}{2}\Delta x/R_{tip}$. Scanning electron microscope (SEM) micrographs of the emitter surface place an upper limit of 200–500 Å on the edge radius of curvature. For a tip-to-tip separation of 10$\mu$, this gives an enhancement factor of 100–250.

Previous measurements on the microlithographically prepared emitters suggest that emission is occurring from atomic-scale surface protrusions. The enhancement due to a hemispherical bump on a flat plane is a factor of three. This effect may or may not be present in the system of the present invention. Therefore, it is included as a range of possible enhancements, between 1 and 3.

The complete enhancement factor can be found approximately by multiplying together the individual factors due to tip radius of curvature, bumps on the tip surface, the tip aspect ratio, and the presence of other tips. The field enhancement for our structure is therefore expected to be in the range $$\beta=(100-250)\times(1-3)\times(10)\times(0.9)=900-6750. \quad (6)$$

For an applied electric field of 20 kV/cm this will produce a local electric field in the range $E_k=E_0\times\beta=20$ kV/cm)$\times 900-6750=1.8\times 10^7-1.35\times 10^8$ V/cm, spanning the range of the $0.3-1\times 10^8$ V/cm enhanced electric field quoted previously.

The last element of the design is the method used to limit the current at the emitter tips. This limiting is necessary to avoid current runaway at the tips. As in the case of gated field emitter arrays, the current limiting can be achieved by mounting the emitter tips on a doped semiconductor crystal, such as n-silicon. The doped semiconductor limits the current available to flow into the base in which the tubules are mounted and therefore limits the current which can flow through the tubule tips. One drawback of that approach is "current hogging". Because tip emission is controlled collectively, rather than individually, the doped semiconductor mounting scheme permits an individual tip (which may be sharper than or otherwise different from the other tis) to emit more than other tips. Because the unique tip is emitting more than the other tips, it draws current away from those tips. Also, the current drawn from these other tips can cause current runaway at the fast-emitting tip. After the fast-emitting tip burns out, the second fastest emitting tip becomes the fastest emitting tip and the problem recurs. Thus, this scheme of current control requires great care to assure that the emitting tips are uniform.

Another possible current limiting scheme involve coating the tips with a thin film of a current limiting material, typically a high temperature material such as a semiconductor or a transition oxide. The material should have a limited saturation mobility or a limited carrier concentration or both. Amorphous or polycrystalline n-silicon, among other materials, may be used. In this approach, current limiting occurs at each emitter tip, protecting each emitter tip and preventing "current hogging". One drawback of this second approach is that because current clamping occurs at the tip, avalanching can occur if the driving voltage applied to the tips is too large, i.e., about 2 to 3 times the saturation voltage. The driving voltage at which avalanche occurs depends greatly on the material used as a current limiter and can be determined empirically or by the application of known theory.

Fortunately, the increased brightness offered by the use of tubules according to the present invention can compensate for the limited driving current that can be applied. While it is not desired to be bound by theory, the high beam brightness from the cathodes according to the present invention can be explained by analogy with velvet or felt cathodes. Measurements with velvet cathodes have shown that the dominant source of electron beam emission is that due to the surface roughness. Similarly, the present invention should have the same dominant source of electron beam emission. For a surface with roughness of characteristic height h and width w (in 100's of μm), and for a cathode not operating in the charge limited regime, the maximum normalized spread angle is calculated to be $$\gamma\beta\delta\theta_{max} = 0.15\sqrt{E_0}\ \frac{h}{(h^2+w^2)^{\frac{1}{2}}} \quad (7)$$

where $E^0$ is the applied macroscopic field in MeV/cm. This maximum in the perpendicular electron velocity occurs for electrons emitted from about 40% down the side of the characteristic bump. In the present invention, however, the electron emission is occurring at or near the top of the protrusion, reducing the maximum normalized spread angle to $$\gamma\beta\delta\theta_{max} = 0.05\sqrt{E_0}\ \frac{h}{(h^2+w^2)^{\frac{1}{2}}} \quad (8)$$

For the parameters of h=10 μm, w=0.4 μm, and $E_0$=20 kV/cm, $\gamma\beta\delta\Theta=2.2$. Thus the normalized brightness is $$B_n = \frac{I}{\pi^2 E_n^2} = \frac{I}{\pi r^2}\ \frac{I}{\pi(\gamma\beta\delta\phi_{max})^2} = \frac{1}{\pi}\ \frac{220\text{A/cm}^2}{(2.2\text{mrad})^2} \quad (9)$$

Figure 2:
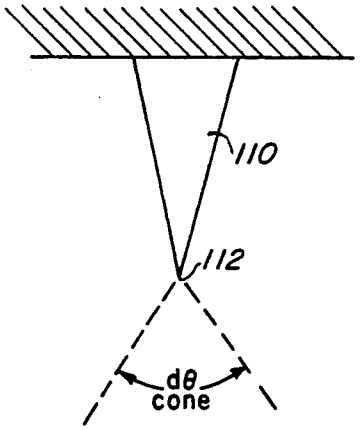
FIG. 2 shows the emission pattern of an electron beam generated by a prior art cone or tip emitter.
Figure 3:
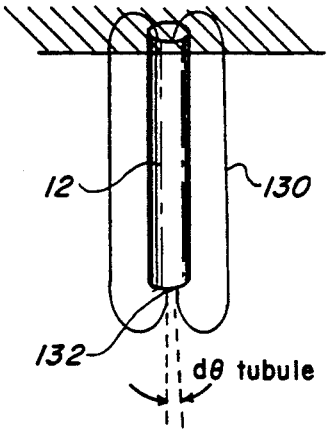
FIG. 3 shows the emission pattern of an electron beam generated by a tubular emitter made according to the present invention.

This brightness exceeds the prior art parameters by approximately one to two orders of magnitude. This benefit of employing a tubular microstructure as opposed to a cone or point can also beexplained by reference to FIGS. 2 and 3. The emission of electrons from point 112 of tip 110 occurs over an angle $d\Theta_{cone}$ and is essentially unbounded by the electrical field near tip 112. As shown in FIG. 3, the hollow tubule 12 has an associated electrical field 130 that extends from tip 132 and loops into the other end of tubule 12. Field 130 restricts the angular spread $d\Theta_{tubule}$ of the electron beam emitted from tip 132 is less than $d\Theta_{cone}$.

Having described the invention, the following examples are given to illustrate specific applications of the invention including the best mode now known to perform the invention. These specific examples are not intended to limit the scope of the invention described in this application.

EXAMPLES (1) Preparation of Emitter Structure

Figure 4:
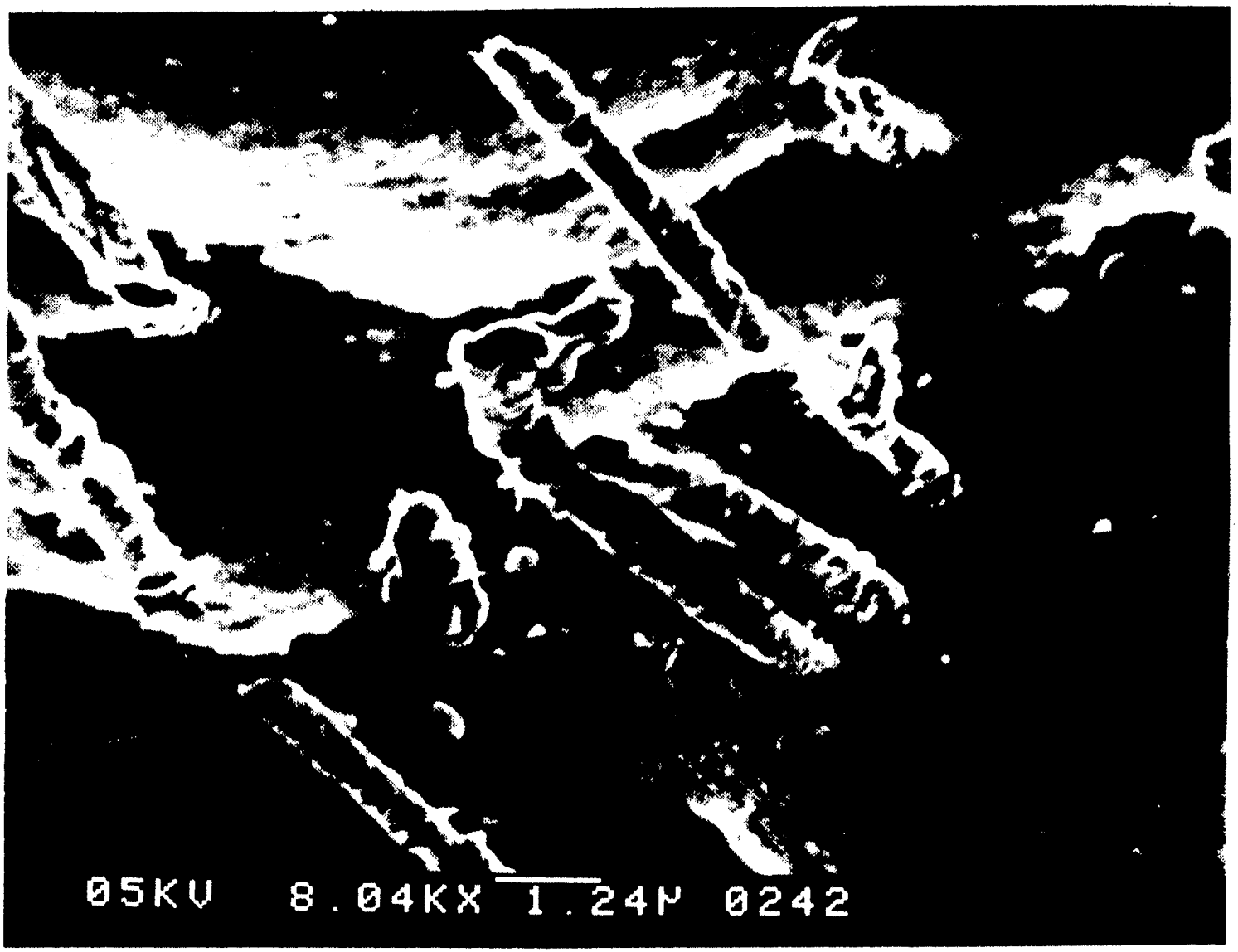
FIG. 4 is a scanning electron micrograph of the tubule composite cathode surface. The tubules project out of the host matrix a distance of 10 μm and end at a sharp right angle. The field enhancement in the neighborhood of the projected cylinder edge is sufficient to generate vacuum field emission for macroscopic electric fields $E \geqq 20$ kV/cm.

The measurements reported here use tubules that are self-assembled from the diacetylenic lipid 1,2-bis(10,12 tricosadiynoyl)-sn-glycero-3-phosphocoline ($DC_{8,9}PC$). Following formation the tubules are catalyzed with a commercial Pd/Sn catalyst. Then they are electrolessly plated with Ni, followed by Au. A low-viscosity epoxy Epon 815/Ancamide 507B resin is used to provide a composite vehicle for alignment of the tubule. The Au/Ni-coated tubules are dispersed in the epoxy and aligned in a 500 G magnetic field. Following polymerization of the epoxy, the composite is cut across its alignment axis into thin 50 μm slices using a microtome. The thin section of tubules and epoxy is etched in an oxygen plasma on one side to a depth of ~5 μm. The plasma etching procedure removes the epoxy but not the metal tubule structures. This etched surface is then coated with a ~0.01 μm coating of gold, followed by a 1-5 μm coating of silver. The silver and gold coated face of the section is soldered to a copper stub with a low temperature Indium alloy solder (Indalloy). Next, the exposed epoxy face of the section is etched until only 10 μm of the epoxy matrix remains. The exposed tubules are broken off at the surface, and the remaining epoxy etched away to leave ~10 μm tall tubules protruding from a gold and silver base. A scanning-electron microscope micrograph of the finished emitter microstructure is shown in FIG. 4.

(2) Demonstration of Functions

The measurements are taken by placing the resultant cathode, mounted on its copper stub, into a cylindrical hole centered in an anodized aluminum cathode holder. The exposed surface of the cathode holder is anodized to prevent unwanted emission from the aluminum surface, while the sides of the cylindrical hole are left uncoated to facilitate good electrical and thermal contact with the aluminum cathode holder. The entire cathode assembly is mounted in a cathode test stand, and is placed opposite a long, OFHC copper cone beam collector, which is held near ground potential. The face of the cone is covered with a stainless steel plate, which has a 1 cm diameter hole cut through the center for passage of the electron beam. The plate is to ensure an approximately planar field structure in the cathode-anode gap. For these measurements, the cathode-anode gap is approximately 3 mm. The combination of the 1 cm diameter aperture in the anode plate and the 3 mm K-A gap reduces the applied field by ~30% from the parallel plate value. A calibrated resistor placed between the beam collector and ground is used to measure the collected electron current.

Microstructure composite materials offer an interesting alternative to microlithographic techniques for the achievement of complex surface micromorphologies. Biomolecular systems, in particular self-assembling biomolecular microstructures, offer a wide variety of microstructure geometries potentially useful for application in physical systems. The hollow, thin-walled, high-aspect ratio tubule microstructures provide a surface micromorphology well suited to the generation of high current, high brightness electron beams. An identical structure is difficult to generate using existing microlithographic techniques.

The devices according to the present invention are particularly useful as cathodes for any purpose where an e-beam source is required. In particular, a cathode according to the present invention may be used in fluorescent lights, video monitors, televisions, flat panel displays, microwave tubes and high power switches, etc.

Obviously, many modifications and variations of the present invention are possible in light of the above teachings. It is therefore to be understood that, within the scope of the appended claims, the invention may be practiced otherwise than as specifically described.

What is claimed is:

1. A cathode having an emitter comprising a plurality of electrically conductive, self-assembled hollow cylinders having outer diameters of no more than about 1.0 μm.

2. A field array emitter comprising a plurality of conductive metal tubules nonrandomly aligned with respect to and extending from an electrically conductive base.

3. The field array emitter of claim 2, wherein said tubules have been aligned in a magnetic, electric or flow field.

4. The field array emitter of claim 2, wherein said tubules extending essentially normal to said conductive base.

5. The field array emitter of claim 2, wherein said tubules have distal ends which extend a height of about 10 μm above the conductive base.

6. The field array emitter of claim 2, further comprising a current limiting means for limiting the current emitted from said array.

7. The field array emitter of claim 6, wherein said current limiting means comprises a semiconductor or transition oxide onto which said conductive base is mounted and electrically connected.

8. The field array emitter of claim 6, wherein said current limiter comprises a coating of a semiconductor or transition metal oxides on the ends of said tubules distal to said base.

9. The field array emitter of claim 8, wherein said coating is n-doped silicon.

10. The field array emitter of claim 2, wherein said conductive base comprises a metal.

11. The field array emitter of claim 10, wherein said conductive base comprises an upper layer of metal which wets and forms an electrical contact with said tubules, and a lower layer of metal which wets and forms an electrical contact with said upper layer and which also covers the proximal ends of said tubules.

12. The field array emitter of claim 2, wherein an end of said conductive base opposite that from which said tubules extend is electrically connected to a macroscopic contact.

13. The field array emitter of claim 12, wherein said macroscopic contact is a plug.

14. A cathode comprising a plurality of nonrandomly aligned electrically conductive, hollow metal cylinders having outer radii of less than about 0.3 μm and which are essentially uniformly and randomly spaced in a plane transverse to the axis of alignment.

15. A method of producing a field emitter array, comprising the steps of:

removing a fraction matrix material from an end of a section of a composite material having nonrandomly aligned metal tubules extend across the length of said section so as to expose a fraction of the length of said tubules at ends thereof;

coating the expose fraction of said tubules with a conductive metallic material so as to wet and form an electrical contact with said metal tubules and to form a smooth electrically conducting surface over the exposed ends of said tubules;

removing the remainder of said matrix material to provide a field array emitter comprising a plurality of conductive metal tubules nonrandomly aligned with respect to and extending from an electrically conductive base.

16. The method of claim 15, further comprising the step of wetting and electrically connecting the smooth, electrically conductive surface to a macroscopic, electrical contact.

17. The method of claim 15, wherein said matrix material is solventable and said step of removing the remainder of said matrix comprises dissolving said matrix.

18. The method of claim 15, wherein at least one of said removing steps comprises plasma etching.

19. The method of claim 13, further comprising the step of coating said exposed ends of said tubules with a current limiting film.

20. The method of claim 19, wherein said current limiting film is a semiconductor or transition oxide.

21. The method of claim 20, wherein said current limiting film is n-doped silicon.

22. The product of the process of claim 15.

* * * * *